US011371175B2

(12) United States Patent
Hombroek et al.

(10) Patent No.: US 11,371,175 B2
(45) Date of Patent: Jun. 28, 2022

(54) LAUNDRY WASHING MACHINE WITH DYNAMIC SELECTION OF LOAD TYPE

(71) Applicant: Midea Group Co., Ltd., Foshan (CN)

(72) Inventors: Phillip C. Hombroek, Prospect, KY (US); Andrew Perry, Fort Mitchell, KY (US); Adam Jones, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 147 days.

(21) Appl. No.: 16/893,328

(22) Filed: Jun. 4, 2020

(65) Prior Publication Data

US 2021/0381150 A1 Dec. 9, 2021

(51) Int. Cl.
*D06F 33/36* (2020.01)
*D06F 34/18* (2020.01)
(Continued)

(52) U.S. Cl.
CPC ..... *D06F 33/36* (2020.02); *D06F 34/06* (2020.02); *D06F 34/18* (2020.02); *D06F 39/088* (2013.01); *D06F 2103/04* (2020.02); *D06F 2103/06* (2020.02); *D06F 2103/18* (2020.02); *D06F 2103/38* (2020.02); *D06F 2105/02* (2020.02); *D06F 2105/48* (2020.02); *D06F 2105/52* (2020.02); *D06F 2105/56* (2020.02)

(58) Field of Classification Search
CPC ..... D06F 34/18; D06F 2103/06
See application file for complete search history.

(56) References Cited

U.S. PATENT DOCUMENTS 4,257,708 A 3/1981 Fukuda
4,889,644 A 12/1989 Amberg et al.
(Continued)

FOREIGN PATENT DOCUMENTS

CN 1378005 A 11/2002
CN 1880543 A 12/2006
(Continued)

OTHER PUBLICATIONS

Leveraging Lasers—Retrieved from: https://www.finisar.com/sites/default/files/resources/Appliance%20Design-VCSEL%20turbidity%20Sensor.pdf Dec. 21, 2015.
(Continued)

*Primary Examiner* — Spencer E. Bell
(74) *Attorney, Agent, or Firm* — Middleton Reutlinger

(57) ABSTRACT

A laundry washing machine and method automate the selection of a load type for a laundry washing machine based in part on sensing multiple times during an initial fill phase of a wash cycle and based in part on a fluid level sensed by a fluid level sensor operatively coupled to a wash tub. The dynamic selection may be based at least in part on a first time at which the fluid level sensor senses a predetermined fluid level while water is being dispensed into the wash tub and a peak time at which the fluid level sensor senses a stabilization of fluid level after water is not being dispensed into the wash tub. The dynamic selection may also be accelerated by skipping the sensing of one or more times in response to determining that an earlier reached time meets a predetermined criterion.

20 Claims, 5 Drawing Sheets

(51) Int. Cl.

| | |
|---|---|
| ***D06F 39/08*** | (2006.01) |
| ***D06F 34/06*** | (2020.01) |
| ***D06F 103/18*** | (2020.01) |
| ***D06F 105/52*** | (2020.01) |
| ***D06F 103/06*** | (2020.01) |
| ***D06F 103/38*** | (2020.01) |
| ***D06F 105/56*** | (2020.01) |
| ***D06F 105/02*** | (2020.01) |
| ***D06F 105/48*** | (2020.01) |
| ***D06F 103/04*** | (2020.01) |

(56) References Cited

U.S. PATENT DOCUMENTS

| | | | | |
|---|---|---|---|---|
| 4,986,093 | A | 1/1991 | Pastryk et al. | |
| 4,987,627 | A | 1/1991 | Cur et al. | |
| 5,031,427 | A | 7/1991 | Pastryk et al. | |
| 5,161,393 | A | 11/1992 | Payne et al. | |
| 5,167,722 | A | 12/1992 | Pastryk et al. | |
| 5,373,714 | A | 12/1994 | Wada | |
| 5,555,583 | A | 9/1996 | Berkcan | |
| 5,560,060 | A | 10/1996 | Dausch et al. | |
| 5,589,935 | A | 12/1996 | Biard | |
| 5,603,233 | A | 2/1997 | Erickson et al. | |
| 5,611,867 | A | 3/1997 | Cooper et al. | |
| 5,731,868 | A | 3/1998 | Okey et al. | |
| 5,737,790 | A | 4/1998 | Badger et al. | |
| 5,768,729 | A | 6/1998 | Cracraft | |
| 5,897,672 | A * | 4/1999 | Badami | D06F 34/18 8/159 |
| 6,023,950 | A * | 2/2000 | Battistella | D06F 34/18 68/12.04 |
| 6,536,243 | B2 | 3/2003 | Sasano | |
| 6,842,929 | B2 | 1/2005 | Kim et al. | |
| 7,062,810 | B2 | 6/2006 | Hardaway et al. | |
| 7,380,303 | B2 | 6/2008 | Bellinetto et al. | |
| 7,392,813 | B2 | 7/2008 | Bertram et al. | |
| 7,421,752 | B2 | 9/2008 | Donadon et al. | |
| 7,451,510 | B2 | 11/2008 | Lee | |
| 7,958,584 | B2 | 6/2011 | Suel, II et al. | |
| 8,505,139 | B2 | 8/2013 | Vanhazebrouck et al. | |
| 8,627,524 | B2 | 1/2014 | Urbanet et al. | |
| 8,719,985 | B2 | 5/2014 | Park et al. | |
| 8,834,646 | B2 | 9/2014 | Bewley, Jr. | |
| 8,910,335 | B2 | 12/2014 | Kim et al. | |
| 9,139,946 | B2 | 9/2015 | Dogan et al. | |
| 9,243,987 | B2 | 1/2016 | Chanda et al. | |
| 9,534,338 | B2 | 1/2017 | Fagstad et al. | |
| 10,400,378 | B2 | 9/2019 | Driussi | |
| 10,612,175 | B2 | 4/2020 | Hombroek | |
| 10,619,286 | B2 | 4/2020 | Pesavento et al. | |
| 2001/0002542 | A1 | 6/2001 | Sasano | |
| 2003/0196278 | A1 | 10/2003 | Durfee | |
| 2004/0244433 | A1 | 12/2004 | Lee et al. | |
| 2005/0022317 | A1 | 2/2005 | Shaffer | |
| 2005/0166334 | A1 | 8/2005 | Clouser | |
| 2008/0041115 | A1 | 2/2008 | Kanazawa et al. | |
| 2008/0276964 | A1 | 11/2008 | Hendrickson et al. | |
| 2010/0095465 | A1 | 4/2010 | Kim et al. | |
| 2012/0060299 | A1 | 3/2012 | Kim et al. | |
| 2012/0103026 | A1 | 5/2012 | Oyama et al. | |
| 2012/0312055 | A1 | 12/2012 | Fagstad et al. | |
| 2013/0125595 | A1 | 5/2013 | Seo et al. | |
| 2013/0312202 | A1 | 11/2013 | Balinski et al. | |
| 2014/0259441 | A1 | 1/2014 | Fulmer et al. | |
| 2014/0123400 | A1 | 5/2014 | Gasparini et al. | |
| 2014/0123403 | A1 | 5/2014 | Zattin et al. | |
| 2014/0326067 | A1 | 11/2014 | Chanda et al. | |
| 2015/0000047 | A1 | 1/2015 | Obregon | |
| 2018/0087198 | A1 | 3/2018 | Kim et al. | |
| 2019/0264372 | A1 | 8/2019 | Kessler et al. | |
| 2019/0352834 | A1 | 11/2019 | Clara et al. | |
| 2020/0071871 | A1 | 3/2020 | Kim et al. | |

FOREIGN PATENT DOCUMENTS

| | | | |
|---|---|---|---|
| CN | 101935936 | A | 1/2011 |
| CN | 102199854 | A | 9/2011 |
| CN | 102199855 | A | 9/2011 |
| CN | 102260981 | A | 11/2011 |
| CN | 102465421 | A | 5/2012 |
| CN | 103306096 | A | 9/2013 |
| CN | 103334257 | | 10/2013 |
| CN | 103334258 | | 10/2013 |
| CN | 103485121 | A | 1/2014 |
| CN | 203514043 | | 4/2014 |
| CN | 103797175 | A | 5/2014 |
| CN | 103898711 | | 7/2014 |
| CN | 104233700 | A | 12/2014 |
| CN | 104790179 | A | 7/2015 |
| CN | 105063956 | | 11/2015 |
| CN | 109477272 | A | 3/2019 |
| CN | 109554889 | A | 4/2019 |
| CN | 110512394 | A | 11/2019 |
| DE | 2844755 | | 4/1980 |
| DE | 102008055643 | A1 | 5/2010 |
| DE | 102010029890 | A1 | 12/2011 |
| EP | 0178031 | | 4/1986 |
| EP | 0787848 | A1 | 8/1997 |
| EP | 0962576 | | 12/1999 |
| EP | 2518203 | | 10/2012 |
| GB | 2262363 | | 6/1993 |
| JP | 04054998 | A | 6/1990 |
| JP | H0332699 | A | 2/1991 |
| JP | H04122384 | A | 4/1992 |
| JP | H06218183 | A | 8/1994 |
| JP | H07171289 | A | 7/1995 |
| JP | H08141273 | A | 6/1996 |
| JP | 2011200526 | | 10/2011 |
| KR | 20140019551 | A | 2/2014 |
| WO | 2007003593 | | 1/2007 |
| WO | WO2012089605 | A1 | 7/2012 |
| WO | WO2014205861 | A1 | 1/2016 |
| WO | WO2018001077 | A1 | 1/2018 |

OTHER PUBLICATIONS

U.S. Patent Office; Office Action issued in U.S. Appl. No. 15/198,890 dated Feb. 9, 2018.

U.S. Patent Office; Restriction Requirement issued in U.S. Appl. No. 15/198,883 dated Jan. 18, 2018.

Transmittal of Related Applications.

U.S. Patent Office; Non-Final Office Action issued in U.S. Appl. No. 15/198,971 dated Apr. 2, 2018.

U.S. Patent Office; Restriction Requirement issued in U.S. Appl. No. 15/198,865 dated Mar. 27, 2018.

U.S. Patent Office; Office Action issued in U.S. Appl. No. 15/198,883 dated Apr. 20, 2018.

U.S. Patent Office; Office Action issued in U.S. Appl. No. 15/198,865 dated Jun. 13, 2018.

International Search Report and Written Opinion issued in Application No. PCT/CN2017/087805 dated Sep. 20, 2017.

International Search Report and Written Opinion issued in Application No. PCT/CN2017/087804 dated Sep. 4, 2017.

International Search Report and Written Opinion issued in Application No. PCT/CN2017/087800 dated Jul. 27, 2017.

International Search Report and Written Opinion issued in Application No. PCT/CN2017/087799 dated Sep. 13, 2017.

U.S. Patent Office; Final Office Action issued in U.S. Appl. No. 15/198,971 dated Oct. 9, 2018.

U.S. Patent Office; Notice of Allowance issued in U.S. Appl. No. 15/198,890 dated Sep. 6, 2018.

U.S. Patent Office; Notice of Allowance issued in U.S. Appl. No. 15/198,883 dated Sep. 12, 2018.

Transmittal of Related Applications dated Dec. 21, 2018.

U.S. Patent Office; Advisory Action issued in U.S. Appl. No. 15/198,971 dated Jan. 22, 2019.

U.S. Patent Office; Notice of Allowance issued in U.S. Appl. No. 15/198,865 dated Jan. 24, 2019.

(56) References Cited

OTHER PUBLICATIONS

U.S. Patent Office; Notice of Allowance issued in U.S. Appl. No. 15/198,971 dated Mar. 7, 2019.
U.S. Patent Office; Office Action issued in U.S. Appl. No. 16/229,521 dated May 26, 2020.
International Search Report and Written Opinion issued in Application No. PCT/CN2021/098144 dated Aug. 30, 2021.
U.S. Patent Office; Notice of Allowance issued in U.S. Appl. No. 16/229,521 dated Nov. 3, 2020.
U.S. Patent Office; Notice of Allowance issued in U.S. Appl. No. 16/355,690 dated Nov. 30, 2021.
U.S. Patent Office; Office Action issued in U.S. Appl. No. 16/355,690 dated Jun. 1, 2021.

* cited by examiner

LAUNDRY WASHING MACHINE WITH DYNAMIC SELECTION OF LOAD TYPE

BACKGROUND

Laundry washing machines are used in many single-family and multi-family residential applications to clean clothes and other fabric items. Due to the wide variety of items that may need to be cleaned by a laundry washing machine, many laundry washing machines provide a wide variety of user-configurable settings to control various aspects of a wash cycle such as water temperatures and/or amounts, agitation, soaking, rinsing, spinning, etc. The settings cycle can have an appreciable effect on washing performance, as well as on energy and/or water consumption, so it is generally desirable for the settings used by a laundry washing machine to appropriately match the needs of each load washed by the machine.

Some laundry washing machines also support user selection of load types, typically based on the types of fabrics and/or items in the load. Some laundry washing machines, for example, have load type settings such as colors, whites, delicates, cottons, permanent press, towels, bedding, heavily soiled items, etc. These manually-selectable load types generally represent specific combinations of settings that are optimized for particular load types so that a user is not required to select individual values for each of the controllable settings of a laundry washing machine.

While manual load type selection in many cases simplifies a user's interaction with a laundry washing machine, such manual selection still can lead to suboptimal performance due to, for example, user inattentiveness or lack of understanding. Therefore, a significant need continues to exist in the art for a manner of optimizing the performance of a laundry washing machine for different types of loads, as well as reducing the burden on users when interacting with a laundry washing machine.

SUMMARY

The invention addresses these and other problems associated with the art by providing a laundry washing machine and method that automate the selection of a load type for a laundry washing machine based in part on sensing multiple times during an initial fill phase of a wash cycle and based in part on a fluid level sensed by a fluid level sensor operatively coupled to a wash tub. In some instances, the dynamic selection may be based at least in part on a first time at which the fluid level sensor senses a predetermined fluid level while water is being dispensed into the wash tub and a peak time at which the fluid level sensor senses a stabilization of fluid level after water is not being dispensed into the wash tub. In addition, in some instances, the dynamic selection may be accelerated by skipping the sensing of one or more times in response to determining that an earlier reached time meets a predetermined criterion.

Therefore, consistent with one aspect of the invention, a laundry washing machine may include a wash tub disposed within a housing, a water inlet configured to dispense water into the wash tub, a fluid level sensor configured to sense a fluid level in the wash tub, and a controller coupled to the water inlet and the fluid level sensor. The controller may be configured to initiate an initial fill phase of a wash cycle by controlling the water inlet to dispense water into the wash tub and to dynamically select a load type for a load disposed in the wash tub from among a plurality of load types based at least in part on a first time at which the fluid level sensor senses a predetermined fluid level while the controller controls the water inlet to dispense water into the wash tub and a peak time at which the fluid level sensor senses a stabilization of fluid level after the controller controls the water inlet to stop dispensing water into the wash tub.

In some embodiments, the predetermined fluid level is a first predetermined fluid level, and the controller is further configured to dynamically select the load type based at least in part on a fill time at which the fluid level sensor senses a second predetermined fluid level while the controller controls the water inlet to dispense water into the wash tub. In addition, in some embodiments, the controller is configured to dynamically select the load type further by selecting a first load type in response to the first time meeting a first load type criterion, selecting the first load type in response to the peak time meeting a second load type criterion even if the first time does not meet the first load type criterion, selecting a second load type in response to the first time meeting a third load type criterion, selecting the second load type in response to the fill time meeting a fourth load type criterion even if the first time does not meet the third load type criterion, and selecting a mixed load type in response to none of the first, second, third and fourth load type criteria being met.

In some embodiments, the first time is a sense time, the first predetermined fluid level is a first detected change in fluid level sensed by the fluid level sensor and the second predetermined fluid level is a minimum fill fluid level sensed by the fluid level sensor. Also, in some embodiments, the predetermined fluid level is a first detected change in fluid level sensed by the fluid level sensor. Moreover, in some embodiments, the predetermined fluid level is a minimum fill fluid level sensed by the fluid level sensor.

In addition, in some embodiments, the controller is configured to determine the stabilization of fluid level being sensed by the fluid level sensor in part by determining a substantially constant fluid level for a predetermined stabilization duration. Moreover, in some embodiments, the controller is further configured to dynamically select the load type prior to sensing the peak time in response to determining that the first time meets a predetermined criterion. Further, in some embodiments, the controller is configured to dynamically select the load type further by comparing the first time and the peak time against a plurality of load type criteria respectively associated with different load types among the plurality of load types.

Some embodiments may also include a weight sensor and the controller may be configured to determine a weight of the load using the weight sensor and to determine the plurality of load type criteria using the determined weight. In addition, in some embodiments, at least a subset of the plurality of load type criteria are determined from linear equations that are functions of load weight. In addition, some embodiments may also include a door providing access to the wash tub and a rotatable basket disposed in the wash tub and configured to support the load, where the weight sensor includes a load cell disposed proximate a corner of the housing, the fluid level sensor includes a pressure sensor in fluid communication with the wash tub, and the controller is configured to determine the weight of the load by determining a tare weight of the wash tub using the weight sensor in response to opening of the door, rotating the rotatable basket and determining a loaded weight of the wash tub using the weight sensor during rotation of the rotatable basket, and determining the weight of the load from a difference between the loaded weight and the tare weight of the wash tub.

Moreover, in some embodiments, the predetermined fluid level is a first detected change in fluid level sensed by the fluid level sensor, the plurality of load type criteria includes a polyester sense criterion and a towels sense criterion, and the controller is configured to dynamically select the load type by selecting a polyester load type in response to the first time meeting the polyester sense criterion and selecting a towels load type in response to the first time meeting the towels sense criterion. Also, in some embodiments, the plurality of load type criteria includes a cotton sense criterion, and the controller is further configured to dynamically select the load type by selecting a cotton load type in response to the first time meeting the cotton sense criterion without meeting the towels sense criterion. In some embodiments, the plurality of load type criteria includes a cotton peak criterion and the controller is further configured to dynamically select the load type by selecting the cotton load type in response to the peak time meeting the cotton peak criterion. Also, in some embodiments, the predetermined fluid level is a first predetermined fluid level, the controller is further configured to dynamically select the load type based at least in part on a fill time at which the fluid level sensor senses a second predetermined fluid level while the controller controls the water inlet to dispense water into the wash tub, the plurality of load type criteria includes a polyester fill criterion and the controller is further configured to dynamically select the load type by selecting the polyester load type in response to the fill time meeting the polyester fill criterion. Moreover, in some embodiments, the controller is further configured to dynamically select the load type by selecting a mixed load type in response to a failure to meet any of the plurality of load type criteria.

In some embodiments, the controller is further configured to control a wash or rinse temperature, a wash or rinse water amount, an agitation duration, an agitation stroke, a soak duration, a spin speed, a spin duration, a cycle time, or a number of phase repeats in response to the selected load type.

Consistent with another aspect of the invention, a laundry washing machine may include a wash tub disposed within a housing, a water inlet configured to dispense water into the wash tub, a fluid level sensor configured to sense a fluid level in the wash tub, and a controller coupled to the water inlet and the fluid level sensor. The controller may be configured to initiate an initial fill phase of a wash cycle by controlling the water inlet to dispense water into the wash tub and to dynamically select a load type for a load disposed in the wash tub from among a plurality of load types based at least in part on a plurality of times determined based upon fluid levels sensed by the fluid level sensor. The controller may further be configured to dynamically select the load type prior to sensing at least one of the plurality of times in response to determining that an earlier reached time among the plurality of times meets a predetermined criterion.

Consistent with yet another aspect of the invention, a laundry washing machine may include a wash tub disposed within a housing and accessible by a door, a rotatable basket disposed within the wash tub and configured to receive a load of laundry, a water inlet configured to dispense water into the wash tub, the water inlet including one or more oscillating sprayers, a weight sensor operatively coupled to the wash tub to sense a weight associated with the wash tub, the weight sensor including a load cell disposed proximate a corner of the housing, a fluid level sensor configured to sense a fluid level in the wash tub, the fluid level sensor including a pressure sensor, and a controller coupled to the water inlet and the weight and fluid level sensors. The controller may be configured to perform a wash cycle on the load disposed in the rotatable basket, and may further be configured to control one or more wash parameters for the wash cycle based upon a dynamically selected load type for the load. In addition, the controller may be configured to dynamically select the load type from among a plurality of load types that includes a polyester load type, a mixed load type, a cotton load type and a towels load type by determining a tare weight of the wash tub using the weight sensor in response to opening of the door, rotating the rotatable basket and determining a weight of the load using the weight sensor and the determined tare weight and during the rotation, after determining the weight of the load, controlling the water inlet to start dispensing water into the wash tub, determining a sense time at which the fluid level sensor senses a first detected change in fluid level while the controller controls the water inlet to dispense water into the wash tub, determining a fill time at which the fluid level sensor senses a predetermined fill level while the controller controls the water inlet to dispense water into the wash tub, after the predetermined fill level is sensed, controlling the water inlet to stop dispensing water into the wash tub, determining a peak time at which the fluid level sensor senses a stabilization of fluid level after the controller controls the water inlet to stop dispensing water into the wash tub, determining a polyester sense criterion, a cotton sense criterion, a towels sense criterion, a polyester fill criterion, and a cotton peak criterion using the determined dry weight, selecting the polyester load type if the sense time meets the polyester sense criterion or if the fill time meets the polyester fill criterion, selecting the towels load type if the sense time meets the towels sense criterion, selecting the cotton load type if the sense time meets the cotton sense criterion without meeting the towels sense criterion or if the peak time meets the cotton peak criterion, and otherwise selecting the mixed load type.

Other embodiments may include various methods of operating a laundry washing machine utilizing the various operations described above.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
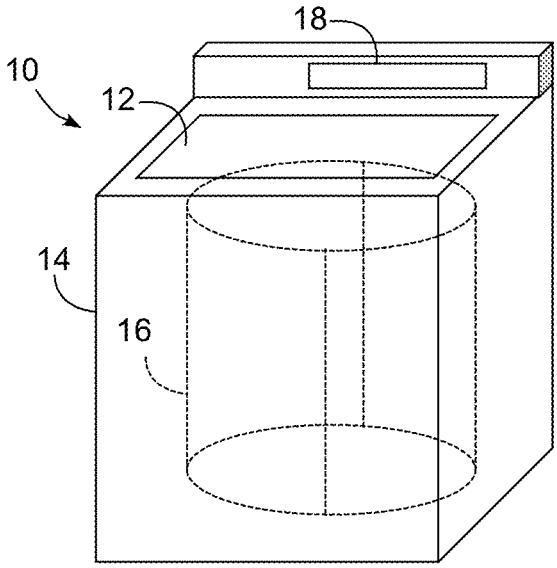
FIG. 1 is a perspective view of a top-load laundry washing machine consistent with some embodiments of the invention.

Embodiments consistent with the invention may be used to automate the selection of a load type for a laundry washing machine. In particular, in some embodiments consistent with the invention, a laundry washing machine may include in part a fluid level sensor configured to sense a fluid level in the wash tub and a controller configured to dynamically select a load type for a load disposed in the wash tub from among a plurality of load types based at least in part on a first time at which the fluid level sensor senses a predetermined fluid level while the controller controls a water inlet to dispense water into the wash tub and a peak time at which the fluid level sensor senses a stabilization of fluid level after the controller controls the water inlet to stop dispensing water into the wash tub. In addition, in some embodiments, a controller of such a laundry washing machine may be configured to dynamically select a load type based at least in part on a plurality of times determined based upon fluid levels sensed by a fluid level sensor, but additionally with the controller configured to dynamically select the load type prior to sensing at least one of the plurality of times in response to determining that an earlier reached time among the plurality of times meets a predetermined criterion.

In this regard, a load type may be considered to represent one of a plurality of different characteristics, categories, classes, subclasses, etc. that may be used to distinguish different loads from one another, and for which it may be desirable to define particular operational settings or combinations of operational settings for use in washing loads of that particular load type. In the illustrated embodiment, load types are principally distinguished based upon different fabric types (e.g., natural, cotton, wool, silk, synthetic, polyester, permanent press, wrinkle resistant, blends, etc.), and optionally, based on different article types (e.g., garments, towels, bedding, delicates, etc.). It will be appreciated, however, that load types may be defined based upon additional or alternative categorizations, e.g., color (colors, darks, whites, etc.); durability (delicates, work clothes, etc.), soil level (lightly soiled, normally soiled, heavily soiled loads, etc.), among others. Load types may also represent categories of loads that are unnamed, and that simply represent a combination of characteristics for which certain combinations of operational settings may apply, particularly as it will be appreciated that some loads may be unsorted and may include a combination of different items that themselves have different characteristics. Therefore, in some embodiments, a load type may be associated with a combination of operational settings that will be applied to a range of different loads that more closely match that load type over other possible load types.

An operational setting, in this regard, may include any number of different configurable aspects of a wash cycle performed by a laundry washing machine including, but not limited to, a wash water temperature, a rinse water temperature, a wash water amount, a rinse water amount, a speed or stroke of agitation during washing and/or rinsing, a spin speed, whether or not agitation is used during washing and/or rinsing, a duration of a wash, rinse, soak, or spin phase of a wash cycle, a number of repeats of a wash, rinse, soak or spin phase, selection between different rinse operation types such as a spray rinse operation or a deep fill rinse operation, pre-treatment such as soaking over time with a prescribed water temperature and specific agitation stroke, etc.

As will become more apparent below, in various embodiments of the invention, a load type may be dynamically selected during an initial fill phase of a wash cycle, i.e., the phase of a wash cycle in which water is first introduced into a wash tub, and generally prior to any agitation of the load and/or draining of fluid from the wash tub, and generally without any extended soaking of the load. Thus, in contrast to some conventional approaches, load type selection may be performed in many embodiments with little or no delay in the initial fill phase, and thus, with little or no impact on the duration of the overall wash cycle. It will be appreciated, however, that in some embodiments, a load may be agitated or at least rotated during a portion of the initial fill phase, e.g., to facilitate a determination of the weight of the load.

Numerous variations and modifications will be apparent to one of ordinary skill in the art, as will become apparent from the description below. Therefore, the invention is not limited to the specific implementations discussed herein.

Turning now to the drawings, wherein like numbers denote like parts throughout the several views, FIG. 1 illustrates an example laundry washing machine 10 in which the various technologies and techniques described herein may be implemented. Laundry washing machine 10 is a top-load washing machine, and as such includes a top-mounted door 12 in a cabinet or housing 14 that provides access to a vertically-oriented wash tub 16 housed within the cabinet or housing 14. Door 12 is generally hinged along a side or rear edge and is pivotable between the closed position illustrated in FIG. 1 and an opened position (not shown). When door 12 is in the opened position, clothes and other washable items may be inserted into and removed from wash tub 16 through an opening in the top of cabinet or housing 14. Control over washing machine 10 by a user is generally managed through a control panel 18 disposed on a backsplash and implementing a user interface for the washing machine, and it will be appreciated that in different washing machine designs, control panel 18 may include various types of input and/or output devices, including various knobs, buttons, lights, switches, textual and/or graphical displays, touch screens, etc. through which a user may configure one or more settings and start and stop a wash cycle.

Figure 2:
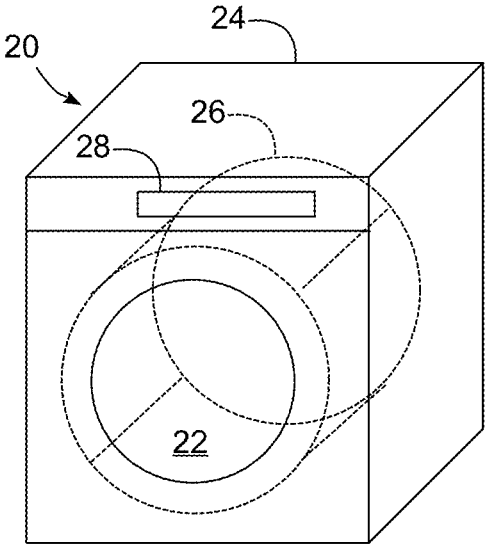
FIG. 2 is a perspective view of a front-load laundry washing machine consistent with some embodiments of the invention.

The embodiments discussed hereinafter will focus on the implementation of the hereinafter-described techniques within a top-load residential laundry washing machine such as laundry washing machine 10, such as the type that may be used in single-family or multi-family dwellings, or in other similar applications. However, it will be appreciated that the herein-described techniques may also be used in connection with other types of laundry washing machines in some embodiments. For example, the herein-described techniques may be used in commercial applications in some embodiments. Moreover, the herein-described techniques may be used in connection with other laundry washing machine configurations. FIG. 2, for example, illustrates a front-load laundry washing machine 20 that includes a front-mounted door 22 in a cabinet or housing 24 that provides access to a horizontally-oriented wash tub 26 housed within the cabinet or housing 24, and that has a control panel 28 positioned towards the front of the machine rather than the rear of the machine as is typically the case with a top-load laundry washing machine. Implementation of the herein-described techniques within a front-load laundry washing machine would be well within the abilities of one of ordinary skill in the art having the benefit of the instant disclosure, so the invention is not limited to the top-load implementation discussed further herein.

Figure 3:
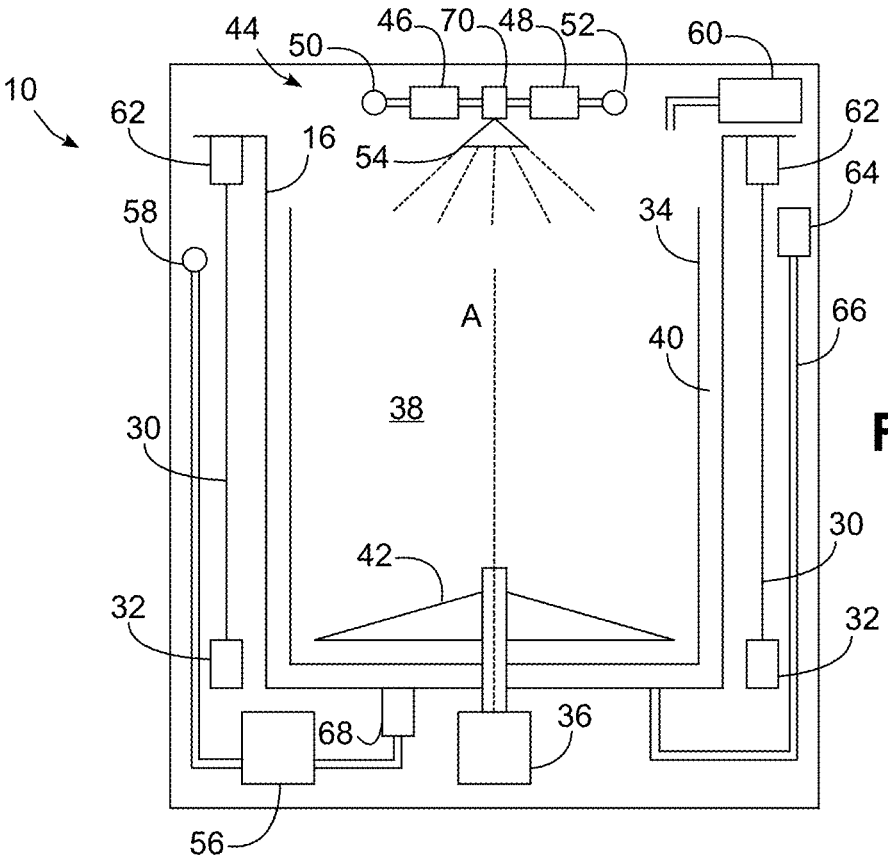
FIG. 3 is a functional vertical section of the laundry washing machine of FIG. 1.

FIG. 3 functionally illustrates a number of components in laundry washing machine 10 as is typical of many washing machine designs. For example, wash tub 16 may be vertically oriented, generally cylindrical in shape, opened to the top and capable of retaining water and/or wash liquor dispensed into the washing machine. Wash tub 16 may be supported by a suspension system such as a set of support rods 30 with corresponding vibration dampening springs 32.

Disposed within wash tub 16 is a wash basket 34 that is rotatable about a generally vertical axis A by a drive system 36. Wash basket 34 is generally perforated or otherwise provides fluid communication between an interior 38 of the wash basket 34 and a space 40 between wash basket 34 and wash tub 16. Drive system 36 may include, for example, an electric motor and a transmission and/or clutch for selectively rotating the wash basket 34. In some embodiments, drive system 36 may be a direct drive system, whereas in other embodiments, a belt or chain drive system may be used.

In addition, in some embodiments an agitator 42 such as an impeller, auger or other agitation element may be disposed in the interior 38 of wash basket 34 to agitate items within wash basket 34 during a washing operation. Agitator 42 may be driven by drive system 36, e.g., for rotation about the same axis as wash basket 34, and a transmission and/or clutch within drive system 36 may be used to selectively rotate agitator 42. In other embodiments, separate drive systems may be used to rotate wash basket 34 and agitator 42.

A water inlet 44 may be provided to dispense water into wash tub 16. In some embodiments, for example, hot and cold valves 46, 48 may be coupled to external hot and cold water supplies through hot and cold inlets 50, 52, and may output to one or more nozzles 54 to dispense water of varying temperatures into wash tub 16. In addition, a pump system 56, e.g., including a pump and an electric motor, may be coupled between a low point, bottom or sump in wash tub 16 and an outlet 58 to discharge greywater from wash tub 16. In some embodiments, it may be desirable to utilize multiple nozzles 54, and in some instances, oscillating nozzles 54, such that water dispensed into the wash tub is evenly distributed over the top surface of the load. As will become more apparent below, in some instances, doing so may maximize the amount of water absorbed by the load prior to water reaching the bottom of the wash tub and being sensed by a fluid level sensor.

In some embodiments, laundry washing machine 10 may also include a dispensing system 60 configured to dispense detergent, fabric softener and/or other wash-related products into wash tub 16. Dispensing system 60 may be configured in some embodiments to dispense controlled amounts of wash-related products, e.g., as may be stored in a reservoir (not shown) in laundry washing machine 10. In other embodiments, dispensing system 60 may be used to time the dispensing of wash-related products that have been manually placed in one or more reservoirs in the machine immediately prior to initiating a wash cycle. Dispensing system 60 may also, in some embodiments, receive and mix water with wash-related products to form one or more wash liquors that are dispensed into wash tub 16. In still other embodiments, no dispensing system may be provided, and a user may simply add wash-related products directly to the wash tub prior to initiating a wash cycle.

It will be appreciated that the particular components and configuration illustrated in FIG. 3 is typical of a number of common laundry washing machine designs. Nonetheless, a wide variety of other components and configurations are used in other laundry washing machine designs, and it will be appreciated that the herein-described functionality generally may be implemented in connection with these other designs, so the invention is not limited to the particular components and configuration illustrated in FIG. 3.

Further, to support dynamic load type selection consistent with the invention, laundry washing machine 10 also includes a fluid level sensor, and in some embodiments, a weight sensor as well. A weight sensor may be used to generate a signal that varies based in part on the mass or weight of the contents of wash tub 16. In the illustrated embodiment, for example, a weight sensor may be implemented in laundry washing machine 10 using one or more load cells 62 that support wash tub 16 on one or more corresponding support rods 30. Each load cell 62 may be an electro-mechanical sensor that outputs a signal that varies with a displacement based on load or weight, and thus outputs a signal that varies with the weight of the contents of wash tub 16. Multiple load cells 62 may be used in some embodiments, while in other embodiments, other types of transducers or sensors that generate a signal that varies with applied force, e.g., strain gauges, may be used. Furthermore, while load cells 62 are illustrated as supporting wash tub 16 on support rods 30, the load cells, or other appropriate transducers or sensors, may be positioned elsewhere in a laundry washing machine to generate one or more signals that vary in response to the weight of the contents of wash tub 16. In some embodiments, for example, transducers may be used to support an entire load washing machine, e.g., one or more feet of a machine. Other types and/or locations of transducers suitable for generating a signal that varies with the weight of the contents of a wash tub will be apparent to one of ordinary skill in the art having the benefit of the instant disclosure. In addition, in some embodiments, a weight sensor may also be used for vibration sensing purposes, e.g., to detect excessive vibrations resulting from an out-of-balance load. In other embodiments, however, no vibration sensing may be used, while in other embodiments, separate sensors may be used to sense vibrations. Further, in some embodiments, a single load cell or other transducer may be used (e.g., disposed proximate a corner of the housing), and the wash basket may be rotated when sensing the weight of the load such that a weight may be determined by averaging multiple weight values captured during rotation of the wash basket.

A fluid level sensor may be used to generate a signal that varies with the level or height of fluid in wash tub 16. In the illustrated embodiment, for example, a fluid level sensor may be implemented using a pressure sensor 64 in fluid communication with a low point, bottom or sump of wash tub 16 through a tube 66 such that a pressure sensed by pressure sensor 64 varies with the level of fluid within the wash tub. It will be understood that the addition of fluid to the wash tub will generate a hydrostatic pressure within the tube that varies with the level of fluid in the wash tub, and that may be sensed, for example, with a piezoelectric or other transducer disposed on a diaphragm or other movable element. It will be appreciated that a wide variety of pressure sensors may be used to provide fluid level sensing, including, among others, combinations of pressure switches that trigger at different pressures. It will also be appreciated that fluid level in the wash tub may also be sensed using various non-pressure based sensors, e.g., optical sensors, laser sensors, etc.

Additional sensors may also be incorporated into laundry washing machine 10. For example, in some embodiments, a turbidity sensor 68 may be used to measure the turbidity or clarity of the fluid in wash tub 16, e.g., to sense the presence or relative amount of various wash-related products such as detergents or fabric softeners and/or to sense the presence or relative amount of soil in the fluid. Further, in some embodiments, turbidity sensor 68 may also measure other characteristics of the fluid in wash tub 16, e.g., conductivity and/or temperature. In other embodiments, separate sensors may be used to measure turbidity, conductivity and/or temperature, and further, other sensors may be incorporated to measure additional fluid characteristics. In other embodiments, no turbidity sensor may be used.

In addition, in some embodiments, a flow sensor 70 such as one or more flowmeters may be used to sense an amount of water dispensed into wash tub 16. In other embodiments, however, no flow sensor may be used. Instead, water inlet 44 may be configured with a static and regulated flow rate such that the amount of water dispensed is a product of the flow rate and the amount of time the water is dispensed. Therefore, in some embodiments, a timer may be used to determine the amount of water dispensed into wash tub 16.

Figure 4:
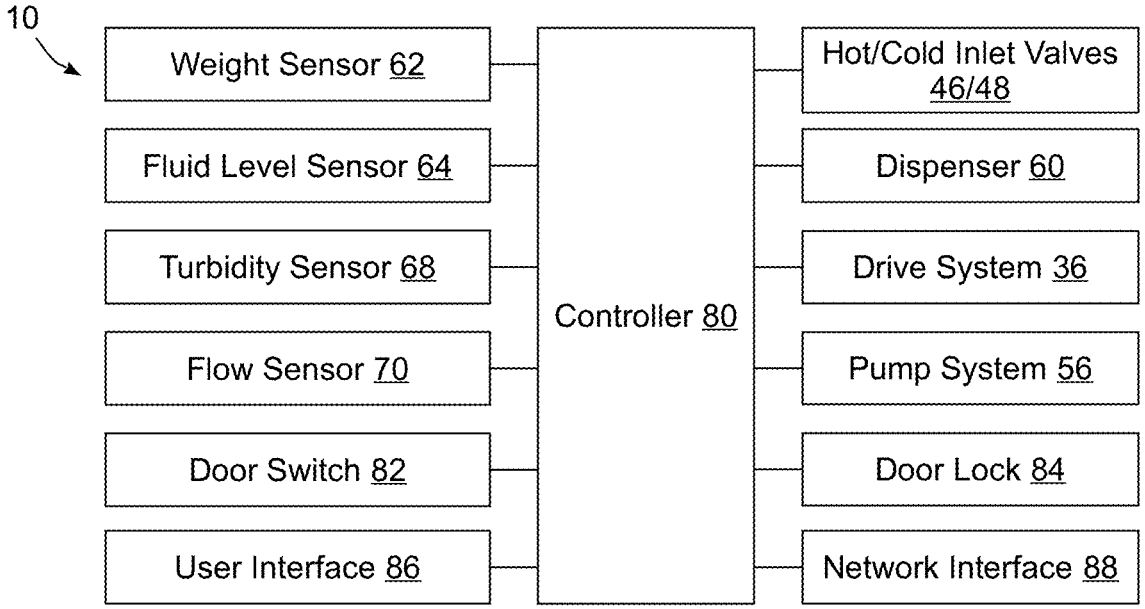
FIG. 4 is a block diagram of an example control system for the laundry washing machine of FIG. 1.

Now turning to FIG. 4, laundry washing machine 10 may be under the control of a controller 80 that receives inputs from a number of components and drives a number of components in response thereto. Controller 80 may, for example, include one or more processors and a memory (not shown) within which may be stored program code for execution by the one or more processors. The memory may be embedded in controller 80, but may also be considered to include volatile and/or non-volatile memories, cache memories, flash memories, programmable read-only memories, read-only memories, etc., as well as memory storage physically located elsewhere from controller 80, e.g., in a mass storage device or on a remote computer interfaced with controller 80.

As shown in FIG. 4, controller 80 may be interfaced with various components, including the aforementioned drive system 36, hot/cold inlet valves 46, 48, pump system 56, weight sensor 62, fluid flow sensor 64, turbidity sensor 68, and flow sensor 70. In addition, controller 80 may be interfaced with additional components such as a door switch 82 that detects whether door 12 is in an open or closed position and a door lock 84 that selectively locks door 12 in a closed position. Moreover, controller 80 may be coupled to a user interface 86 including various input/output devices such as knobs, dials, sliders, switches, buttons, lights, textual and/or graphics displays, touch screen displays, speakers, image capture devices, microphones, etc. for receiving input from and communicating with a user. In some embodiments, controller 80 may also be coupled to one or more network interfaces 88, e.g., for interfacing with external devices via wired and/or wireless networks such as Ethernet, Bluetooth, NFC, cellular and other suitable networks. Additional components may also be interfaced with controller 80, as will be appreciated by those of ordinary skill having the benefit of the instant disclosure. Moreover, in some embodiments, at least a portion of controller 80 may be implemented externally from a laundry washing machine, e.g., within a mobile device, a cloud computing environment, etc., such that at least a portion of the functionality described herein is implemented within the portion of the controller that is externally implemented.

In some embodiments, controller 80 may operate under the control of an operating system and may execute or otherwise rely upon various computer software applications, components, programs, objects, modules, data structures, etc. In addition, controller 80 may also incorporate hardware logic to implement some or all of the functionality disclosed herein. Further, in some embodiments, the sequences of operations performed by controller 80 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Figure 5:
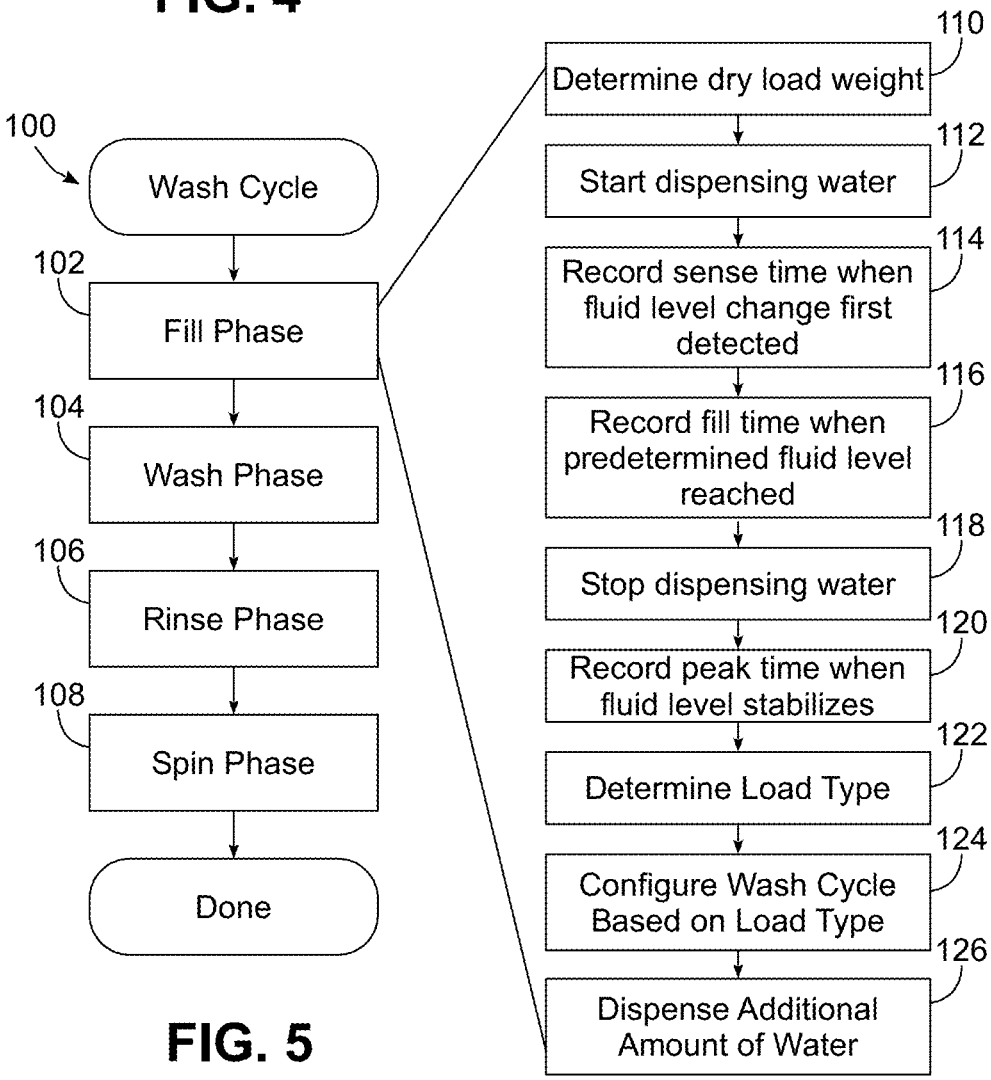
FIG. 5 is a flowchart illustrating an example sequence of operations for implementing a wash cycle in the laundry washing machine of FIG. 1.

Now turning to FIG. 5, and with continuing reference to FIGS. 3-4, a sequence of operations 100 for performing a wash cycle in laundry washing machine 10 is illustrated. A typical wash cycle includes multiple phases, including an initial fill phase 102 where the wash tub is initially filled with water, a wash phase 104 where a load that has been placed in the wash tub is washed by agitating the load with a wash liquor formed from the fill water and any wash products added manually or automatically by the washing machine, a rinse phase 106 where the load is rinsed of detergent and/or other wash products (e.g., using a deep fill rinse where the wash tub is filled with fresh water and the load is agitated and/or a spray rinse where the load is sprayed with fresh water while spinning the load), and a spin phase 108 where the load is spun rapidly while water is drained from the wash tub to reduce the amount of moisture in the load.

It will be appreciated that wash cycles can also vary in a number of respects. For example, additional phases, such as a pre-soak phase, may be included in some wash cycles, and moreover, some phases may be repeated, e.g., including multiple rinse and/or spin phases. Each phase may also have a number of different operational settings that may be varied for different types of loads, e.g., different times or durations, different water temperatures, different agitation speeds or strokes, different rinse operation types, different spin speeds, different water amounts, different wash product amounts, etc.

In embodiments consistent with the invention, a load type may be automatically and dynamically selected during the initial fill phase 102 based at least in part on multiple times determined based upon various fluid levels sensed by the fluid level sensor 64 during and after the dispensation of water into the wash tub by water inlet 44. In some embodiments, the automatic and dynamic selection may be performed in response to user selection of a particular mode (e.g., an "automatic" mode), while in other embodiments, automatic and dynamic selection may be used for all wash cycles. In still other embodiments, automatic and dynamic selection may further be based upon additional input provided by a user, e.g., soil level, article type, fabric type, article durability, etc.

In some embodiments, dynamic selection is based in part on judging the absorptivity of the fabric in the load against the weight of the load. A dry weight may be determined for the load in some embodiments at the beginning of a washing cycle (e.g., at the beginning of the fill phase) using a weight sensor and prior to dispensing any water into the wash tub. Thereafter, water may dispensed into the wash tub, and fluid levels sensed by a fluid level sensor while dispensing water into the wash tub as well as after water dispensing has been paused or stopped may be used to determine multiple times that may be compared against various load type criteria to select a load type from among a plurality of different load types. The load type may then be used, for example, to determine if and how much additional water should be added for the initial fill, as well as other operational settings for the wash cycle.

As will become more apparent below, in particular, a first time at which the fluid level reaches a predetermined fluid level while dispensing water into the wash tub and a peak time at which the fluid level stabilizes after the dispensing of water into the wash tub has been stopped or paused may be used to categorize a load into one of multiple load types, as both times are affected in part by the absorbency of the articles in a load. In some instances, the first time alone may be able to categorize some loads, as, for example, the first time may be relatively short for loads containing only low absorbency fabrics such as polyesters and other synthetic materials, or may be relatively long for loads containing highly absorbent articles or fabrics such as cotton articles, bedding or towels. By incorporating the peak time into the determination, however, it has been found that additional loads may be appropriately categorized, e.g., loads where absorbency is such that the first time alone is unable to suitably categorize the load. In addition, in some embodiments, the first time may be a sense time where water is first detected by a fluid level sensor, and an additional time, e.g., a fill time at which the fluid level reaches another predetermined fluid level such as a desired minimum fill level while dispensing water into the wash tub, may also be incorporated into the determination to categorize additional loads.

In addition, as will also become more apparent below, the weight of the load may also factor into the dynamic detection of load type, e.g., by determining appropriate criteria against which the times are compared when determining whether a load is appropriately categorized into a particular load type. Further, as will also become more apparent below, in some instances it may not be necessary to wait until all of the times have been determined, as in some cases an earlier time may be used to appropriately categorize a load without waiting for determinations of later times, thereby accelerating the load type determination.

In some instances, for example, if a load type determination can be made prior to filling to a predetermined minimum level and allowing the fluid level to stabilize, it may not be necessary to stop or pause filling, and instead filling may continue uninterrupted to a dynamically calculated fluid level based on the selected load type. Doing so may therefore shorten the initial fill phase and thus the overall wash cycle duration.

In the embodiment illustrated and discussed hereinafter, for example, four different load types are defined, a polyester load type that represents a load that is entirely or mostly comprised of polyester articles (which tend to be minimally absorbent), a cotton load type that is entirely or mostly comprised of cotton articles (which tend to be fairly absorbent), a towels load type that is entirely or mostly comprised of towels (which tend to be highly absorbent), and a mixed load type that, based upon a general absorbency, is likely comprised of some mixture of polyester and cotton articles). It will be appreciated, however, that the number and configurations of load types may vary in different embodiments, so the invention is not limited to the specific combination of load types described herein.

In addition, in this embodiment, three times are recorded during the initial fill phase based upon fluid levels. A first time, referred to as a sense time, is a time during the initial fill phase that a fluid level change is first sensed by the fluid level sensor, i.e., a first detected change in fluid level sensed by the fluid level sensor. It will be appreciated, in particular, that when water is first dispensed into the wash tub and onto the load, the fluid level sensor will initially not detect any water at the bottom of the wash tub for some period of time, and generally not until the articles in the load have become mostly saturated with water. Thus, as the absorbency of the load increases, the sense time will generally increase as well.

A second time, referred to as a fill time, is a time during the initial fill phase that the fluid level reaches a predetermined fluid level, e.g., a minimum fluid level for the initial fill, representing the minimum amount of water that would be recommended for the load regardless of type. In some embodiments, however, a fluid level different from a minimum fluid level may be used, and further while in some embodiments the predetermined fluid level may be a constant fluid level, in other embodiments the predetermined fluid level may be varied based upon weight and/or other load characteristics (e.g., based upon user input, such as soil level, load size, etc.). As with the sense time, the fill time also generally increases with the absorbency of the load.

A third time, referred to as a peak time, is a time during the initial fill phase that the fluid level stabilizes after water dispensing has been stopped or paused. In particular, it will be appreciated that after the water inlet is shut off, the fluid level in the wash tub will generally continue to increase as water drips from the load. The peak time may be measured based upon when the fluid level stabilizes, i.e., when the fluid level stops increasing. In some embodiments, this stabilization may be based upon sensing no change in the fluid level (or alternatively, a change below a predetermined threshold) for a predetermined stabilization duration, e.g., about 15 seconds. As with the sense and fill times, the peak time also generally increases with the absorbency of the load. Furthermore, the peak time may be adjusted in some embodiments to not include the stabilization duration, i.e., such that the peak time is representative of the time at which the fluid level ceased increasing.

It will be appreciated that in other embodiments, additional times may be used, and in some embodiments, only one of the first and second times may be used. Furthermore, where the load type may be determined from the first time alone, neither of the second or third times may need to be determined, and where the load type may be determined from the first and second times, the third time may not need to be determined.

In addition, it will be appreciated that the multiple times that are determined in connection with selecting a load type are generally times relative to one or more points of reference, and thus are associated with various durations from various points of reference. In the illustrated embodiment, for example, each of the first and second times may be used to calculate durations from the beginning of water dispensing, while the third time may be used to calculate a duration from the point at which water dispensing is stopped or paused. In some instances, for example, the duration may be determined based upon the difference between the second and third times, given that in the illustrated embodiment water dispensing is stopped at the second time. The invention, however, is not limited to durations that are relative to these particular points of reference, so it will be appreciated that in other embodiments each of the times used in dynamic load type selection may be used to determine durations relative to other points of reference, and that each of the times may share a common point of reference or may be based on a completely separate point of reference in different embodiments.

Blocks 110-126 of FIG. 5, for example, illustrate an example sequence of operations capable of being performed during initial fill phase 102 in order to dynamically select a load type consistent with some embodiments of the invention. As illustrated by block 110, for example, a dry load weight may be determined using a weight sensor, and then the water inlet may be controlled to start dispensing water in block 112. Thereafter, when a change in the fluid level is first sensed by the fluid level sensor, the time at which this occurs may be recorded as the sense time in block 114. Furthermore, when a predetermined fluid level (e.g., a minimum fill level) is sensed by the fluid level sensor, the time at which this occurs may be recorded as the fill time in block 116.

In addition, when the predetermined fluid level is reached, the water inlet is controlled to stop dispensing water in block 118, and when the fluid level is determined to be stabilized (e.g., when the fluid level remains substantially constant for at least 15 seconds), the time at which this occurs (or alternatively the beginning time at which the fluid level stopped increasing) may be recorded as the peak time in block 120.

Next, in block 122, the load type is determined based upon the first, second and third times and the dry load weight (in a manner discussed in further detail below), and in block 124, the wash cycle is configured based upon the determined load type. For example, each load type may be associated with a set of operational settings stored in controller 80 such that selection of a particular load type causes controller 80 to access the set of operational settings for the selected load type when completing the remainder of the wash cycle.

Next, block 126 optionally dispenses an additional amount of water to complete the fill phase. For example, the additional amount of water may be selected to provide a total amount of dispensed water selected based upon load type or selected via a separate load size selection by the user. In other embodiments, the amount of water dispensed in blocks 112-118 may be the total amount of water dispensed during the fill phase, and block 126 may be omitted. Nonetheless, in some embodiments, even when no additional water is dispensed after selecting load type, the load type is selected prior to transitioning to the wash phase, and in some instances prior to any agitation of the load and/or draining of fluid from the wash tub. Furthermore, it will be appreciated that the amount of time expended selecting the load type may be minimal or even imperceptible in some embodiments.

In order to select from the aforementioned load types in the illustrated embodiment, a number of load type criteria may be defined. Furthermore, in the illustrated embodiment, at least some of these various load type criteria are load weight dependent, such that the criteria vary with load weight.

It may be desirable, for example, to utilize linear equations of the form $y=mx+b$, where y is a threshold time or duration, x is the load weight, m is the rate at which the threshold time or duration increases as weight increases, and b is the y-intercept that best represents the data at realistic load sizes. In some embodiments, the linear equations may be empirically determined, and in some embodiments, other equations, e.g., polynomial or non-linear equations, may be used to represent the load type criteria. In other embodiments, load type criteria may be based on fuzzy logic or neural network-derived thresholds. Other manners of mapping the determined times to different load types will be appreciated by those of ordinary skill having the benefit of the instant disclosure.

In the illustrated embodiment, for example, six different load criteria may be used to map the sense, fill and peak times to the polyester, mixed, cotton and towel load types. In this embodiment, the criteria associated with the sense and fill times are based upon a duration from the start of dispensing water to the respective sense and fill times, and all are based on linear equations that are function of the dry weight of the load. An additional criterion associated with the peak time, however, is based on a duration from the end of dispensing water (or alternatively, the fill time) to the peak time, and is not a function of the dry weight of the load, but is instead a constant threshold.

A first load criterion that may be used is a polyester sense criterion that may be used to determine when the sense time indicates that the load type is a polyester load type. In some embodiments, this criterion defines a weight-varying threshold that is met when the sense time or duration is below the threshold.

A second load criterion that may be used is a towels sense criterion that may be used to determine when the sense time indicates that the load type is a towels load type. In some embodiments, this criterion defines a weight-varying threshold that is met when the sense time or duration is above the threshold.

A third load criterion that may be used is a cotton sense criterion that may be used to determine when the sense time indicates that the load type is a cotton load type. In some embodiments, this criterion defines a weight-varying threshold that is met when the sense time or duration is above the threshold, but still below the weight-varying threshold for the towels sense criterion.

A fourth load criterion that may be used is a cotton peak criterion that may be used to determine when the peak time indicates that the load type is a cotton load type. In some embodiments, this criterion defines a weight-independent threshold that is met when the peak time or duration is above the threshold, even when the cotton sense and towels sense criteria are not met by the sense time or duration.

A fifth load criterion that may be used is a polyester fill criterion that may be used to determine when the fill time indicates that the load type is a polyester load type. In some embodiments, this criterion defines a weight-varying threshold that is met when the fill time or duration is below the threshold, even when the polyester sense criterion is not met by the sense time or duration.

Further, in some embodiments, a sixth load criterion may be used, and may be referred to as a mixed sense criterion that is used to determine whether to evaluate the cotton peak criterion or the polyester fill criterion based upon whether the sense time is more indicative of a cotton load type than a polyester load type. In some embodiments, this criterion defines a weight-varying threshold that, when the sense time or duration is above the threshold, indicates that the peak time should be evaluated against the cotton peak criterion to select between the cotton and mixed load types. In contrast, when the sense time or duration is below the threshold, the criterion indicates that the fill time should be evaluated against the polyester fill criterion to select between the polyester and mixed load types. If none of the first five load criteria is met, then the load is determined to be a mixed load type.

It will be appreciated that the various criteria discussed herein may be determined empirically in some embodiments, and may be specific to a particular laundry washing machine design. In addition, in some embodiments, additional factors may be considered in such criteria, e.g., water inlet flow rate, water temperature, etc.

Figure 6:
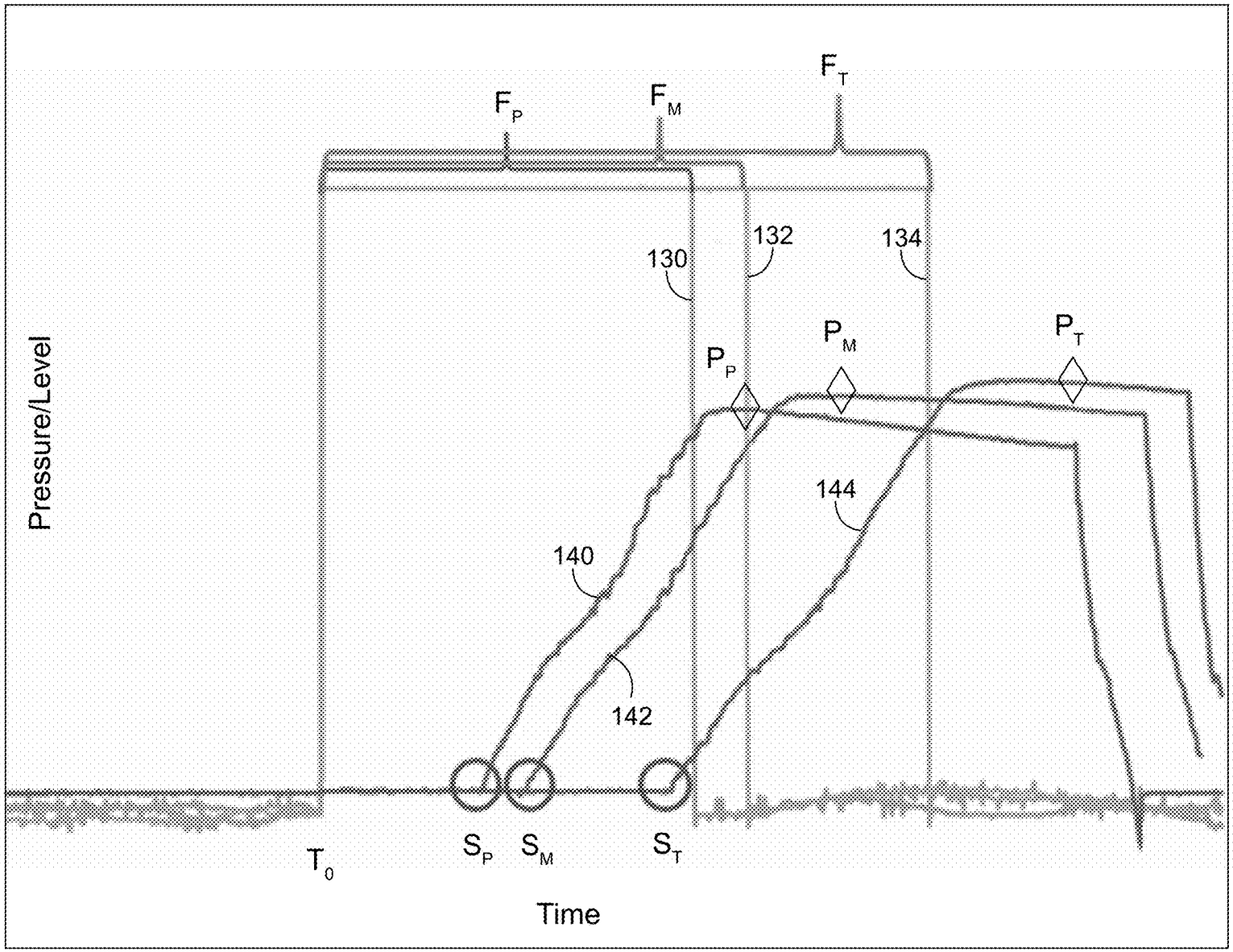
FIG. 6 is a graph illustrating plots of fluid levels over time for example polyester, towels and mixed loads.

FIG. 6, for example, illustrates fluid level plots for three different representative loads during an initial fill operation, the first having a polyester load type and represented using the subscript "P", the second having a mixed load type and represented using the subscript "M", and the third having a towels load type and represented using the subscript "T". Plots 130, 132 and 134 respectively represent the duration of the initial minimum fill, with each starting to fill the wash tub at time $T_0$, and plots 140, 142, and 144 respectively represent the fluid levels sensed by the fluid level sensor for each of the polyester, mixed and towels loads. Times $S_P$, $S_M$ and $S_T$ (represented by the circles) respectively represent the sense times for the three loads, where the fluid level initially begins to rise. Times $F_P$, $F_M$ and $F_T$ (represented by the brackets) respectively represent the fill times for the three loads, where the predetermined fluid level is reached. Times $P_P$, $P_M$ and $P_T$ (represented by the diamonds) respectively represent the peak times for the three loads, where the fluid level stabilizes after the completion of the initial fill. It will be appreciated that since the towels load is generally more absorbent than the mixed load, and the mixed load is generally more absorbent than the polyester load, the various sense, fill and peak times for the three loads reflect these absorbency differences.

Figure 7:
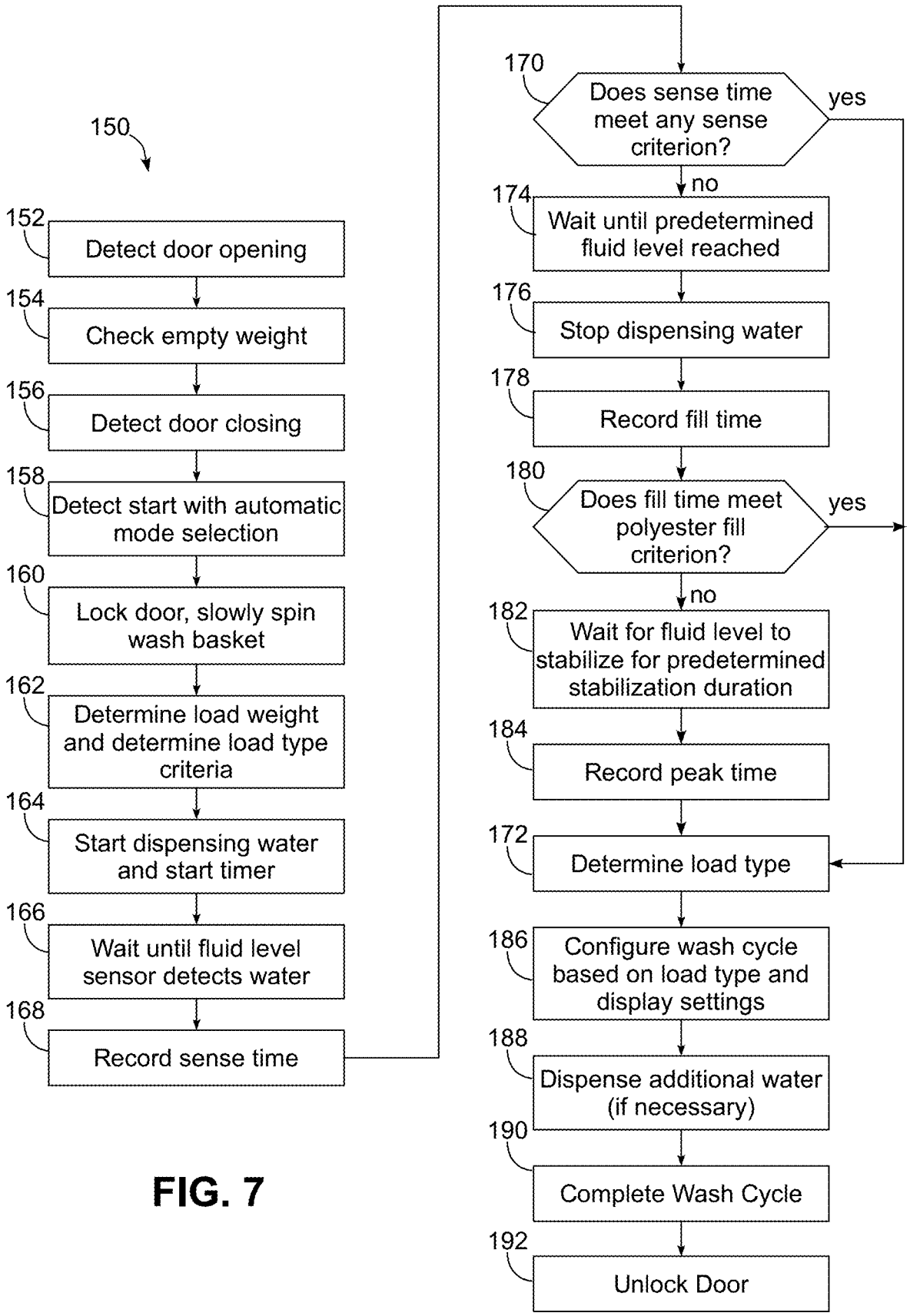
FIG. 7 is a flowchart illustrating another example sequence of operations for implementing a wash cycle in the laundry washing machine of FIG. 1.

Now turning to FIG. 7, this figure illustrates another sequence of operations 150 that may be used to implement a wash cycle with dynamic load type selection consistent with the invention. Block 152 initially detects opening of the washing machine door, e.g., using door switch 82, and upon opening, block 154 determines a tare weight assuming wash tub 16 is empty using weight sensor 62.

Block 156 then detects the door closing using door switch 82. Block 156 may also check the output of weight sensor 62 to determine that a load has been placed in the wash tub. Block 158 then detects a selection by the user of an "automatic" mode along with a request to start the wash cycle, and then passes control to block 160 to initiate actuation of door lock 84 to lock the door. A safety algorithm may also be performed at this time to determine whether the machine is able to proceed with a wash cycle. At this time, the controller may also begin to slowly spin the wash basket, particularly in the event that the weight sensor 62 is implemented using an offset sensor that is sensitive to the distribution of a load in the wash tub (e.g., a single load cell disposed proximate a corner of the housing).

Next, block 162 determines the load weight using weight sensor 62 and the tare weight determined in block 154, e.g., by averaging multiple weight sensor readings captured over the course of several revolutions of the wash basket and then computing a difference between this loaded weight and the tare weight determined in block 154. At this time, it may also be desirable to use the load weight to calculate the various weight-varying load type criteria thresholds discussed above.

Next, in block 164, water inlet 44 is controlled to start dispensing water into the wash tub. It is generally desirable to distribute the water evenly across the load, e.g., using multiple and/or oscillating nozzles, and in some instances it may be desirable to continue spinning the wash basket at a slow speed to further distribute the water more evenly. In addition, a time may be started at this time to provide a consistent point of reference for the time determinations.

As noted above, right after the water is turned on, pressure sensor 64 will not detect any water at the bottom of the basket because of the fabric's absorptivity. Different fabrics have different absorptivity levels (generally, from lowest to highest: delicates, polyester, mixed, cotton, towels). The fabric type and amount of fabric (e.g., as represented by weight) will both affect how much water is absorbed and how long it takes for water to reach the bottom of the basket. Thus, once the pressure sensor detects a very small amount of water at the bottom of the basket representing a first detected change in fluid level sensed by the fluid level sensor (block 166), the elapsed time between this moment and the water inlet being opened to start dispensing water is recorded as the sense time (block 168).

As noted above, in the illustrated embodiment, there are several cases where the sense time alone may be enough to determine the load type. In particular, there are three cases, based on the polyester sense criterion, the cotton sense criterion and the towels sense criterion, where sense time is enough to decide the load type, and if any are met, then the rest of the sensing phase may be skipped and the load type may be selected prior to reaching and recording the later times. In some instances, the time savings may be several minutes or more, particularly in the instance where a load contains only low absorbency fabrics and water begins dropping to the bottom of the wash tub very soon after water dispensing starts. Thus, block 170 may determine if any of the aforementioned criteria are met, and if so, pass control to block 172 to determine the load type based upon the sense time.

If not, however, block 170 passes control to block 174 to continue filling the wash tub and wait until a predetermined fluid level, e.g., a minimum fill fluid level, is reached. Once this fluid level is reached, the water inlet is turned off (block 176) and the time elapsed between this point and the water turning on is recorded as the fill time (block 178). In the illustrated embodiment, filling to the minimal water level may be used to differentiate between polyester and mixed or mixed and cotton loads; however, fill time itself may be used to tell the difference between polyester and mixed loads if the sense time alone is insufficient to distinguish between the two. Thus, block 180 may determine if the fill time meets the polyester fill criterion, and if so, passes control to block 172 and skip the remainder of the sensing phase.

If, however, the criterion is not met, block 180 passes control to block 182 to wait for the fluid level to stabilize for a predetermined stabilization duration (e.g., about 15 seconds in some embodiments). As noted above, once the water inlet is stopped, the water level will continue to increase as water drips from the load. These small water level changes may be sensed by the pressure sensor, and once the water level has stagnated or stabilized for the desired duration, the time elapsed between the water being shut off and the last increase in pressure sensor readings may be recorded as the peak time in block 184.

Next, control passes to block 172 to determine the load type based on the three recorded times. Then, in block 186, the controller may configure the wash cycle based on the load type, and may optionally display these settings to a user on a display of the machine. Block 188 optionally dispenses an additional amount of water to complete the fill phase (e.g., if based upon the weight and/or load type it is determined that a larger volume of water is required). The wash cycle is then completed in block 190 using the operational settings associated with the selected load type, and upon completion of the wash cycle, the door is unlocked in block 192 by deactivating door lock 84.

Figure 8:
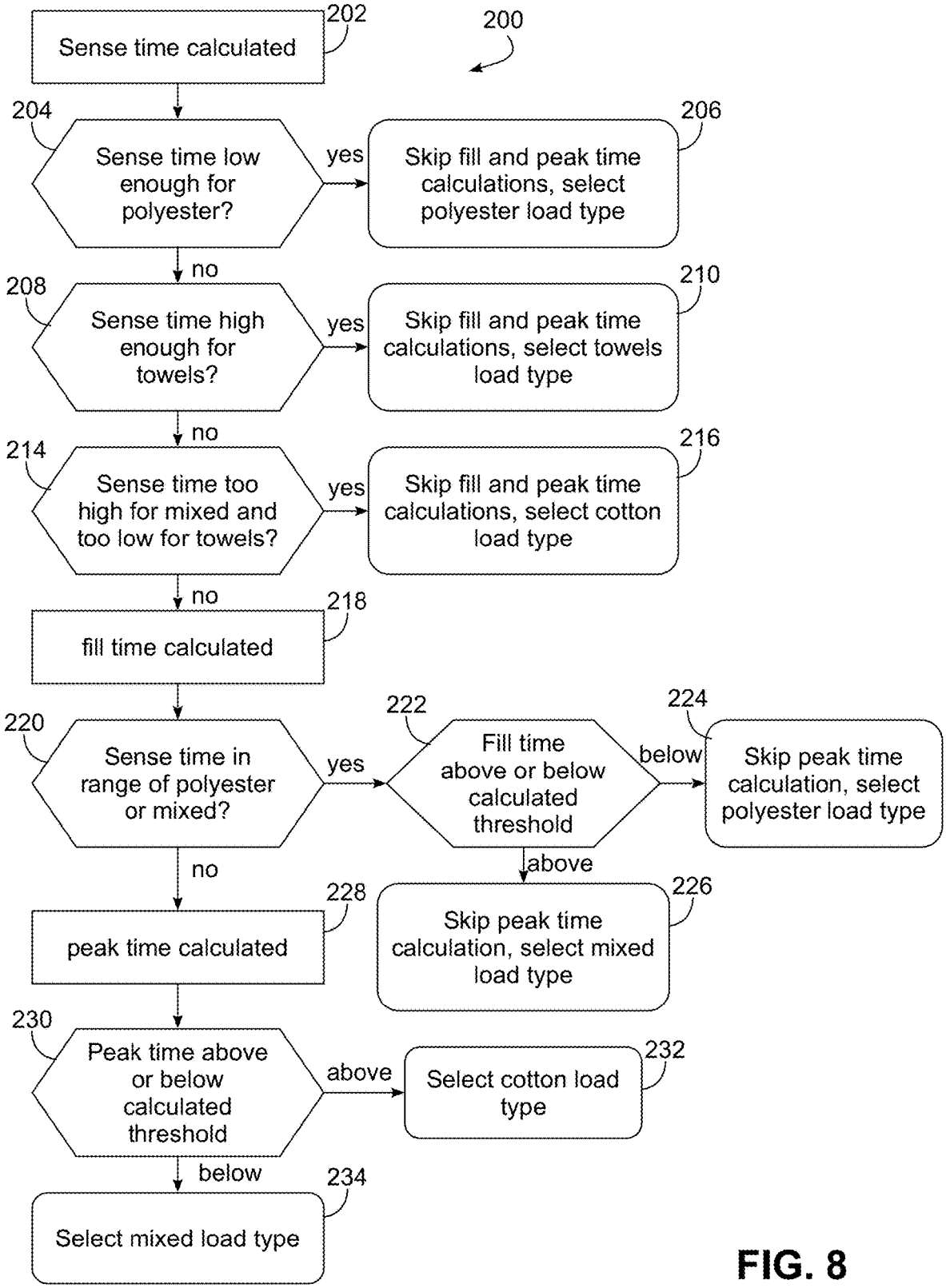
FIG. 8 is a flowchart illustrating an example sequence of operations for performing the load type determination referenced in FIG. 7.

While it will be appreciated that dynamic load type selection based upon the aforementioned times may be implemented in a number of other manners, one example implementation of a load type selection operation such as is performed in block 172 is illustrated by sequence of operations 200 in FIG. 8. In general, in the illustrated embodiment, the load weight and the sense time may be used to categorize a load into one of five categories:

1) Known to be polyester from sense time

2) Cannot tell between polyester and mixed, needs fill time to decide

3) Cannot tell between mixed and cotton, needs peak time to decide

4) Known to be cotton from sense time.

5) Known to be towels from sense time.

Thus, sequence 200 may be used to use the sense time, and if necessary, either of the fill and peak times, in order to determine the load type. Furthermore, sequence 200 may, in some instances, select a load type prior to reaching the fill and/or peak times, thereby dynamically shortening a sensing phase during which the load type is determined.

As shown in block 202, sequence 200 may begin by calculating the sense time, and then determining in block 204 (e.g., using the polyester sense criterion) whether the sense time is low enough for the polyester load type. If so, control passes to block 206 to skip the fill and peak time calculations and select the polyester load type.

Otherwise, block 204 passes control to block 208 to determine (e.g., using the towels sense criterion) whether the sense time is high enough for the towels load type. If so, control passes to block 210 to skip the fill and peak time calculations and select the towels load type.

Otherwise, block 208 passes control to block 214 to determine (e.g., using the cotton sense criterion) whether the sense time is high enough for the cotton load type, or more specifically, if the sense time is too high for the mixed load type but too low for the towels load type. If so, control passes to block 216 to skip the fill and peak time calculations and select the cotton load type.

Otherwise, block 214 passes control to block 218 to calculate the fill time, and block 220 determines (e.g., using the mixed sense criterion) whether to evaluate the cotton peak criterion or the polyester fill criterion based upon whether the sense time is more indicative of a cotton load type than a polyester load type. Specifically, if block 220 determines that the sense time is in range of a polyester or mixed load type, control passes to block 222 to determine (e.g., using the polyester fill criterion) whether the fill time is above or below the calculated threshold associated with the criterion. If below, control passes to block 224 to skip the peak time calculation and select the polyester load type, and if above, control passes to block 226 to skip the peak time calculation and select the mixed load type.

Returning to block 220, if it is determined that the sense time is not in range of a polyester or mixed load type, control passes to block 228 to calculate the peak time, and then to block 230 to determine (e.g., using the peak cotton criterion) whether the peak time is above or below the calculated threshold associated with the criterion. If above, control passes to block 232 to select the cotton load type, and if below, control passes to block 234 to select the mixed load type.

Various additional modifications may be made to the illustrated embodiments consistent with the invention. Therefore, the invention lies in the claims hereinafter appended.

What is claimed is:

1. A laundry washing machine, comprising:

a wash tub disposed within a housing and accessible by a door;

a rotatable basket disposed within the wash tub and configured to receive a load of laundry;

a water inlet configured to dispense water into the wash tub, the water inlet including one or more oscillating sprayers;

a weight sensor operatively coupled to the wash tub to sense a weight associated with the wash tub, the weight sensor including a load cell disposed proximate a corner of the housing;

a fluid level sensor configured to sense a fluid level in the wash tub, the fluid level sensor comprising a pressure sensor; and a controller coupled to the water inlet and the weight and fluid level sensors, the controller configured to perform a wash cycle on the load disposed in the rotatable basket, the controller further configured to control one or more wash parameters for the wash cycle based upon a dynamically selected load type for the load, the controller configured to dynamically select the load type from among a plurality of load types that includes a polyester load type, a mixed load type, a cotton load type and a towels load type by:

determining a tare weight of the wash tub using the weight sensor in response to opening of the door;

rotating the rotatable basket and determining a weight of the load using the weight sensor and the determined tare weight and during the rotation;

after determining the weight of the load, controlling the water inlet to start dispensing water into the wash tub;

determining a sense time at which the fluid level sensor senses a first detected change in fluid level while the controller controls the water inlet to dispense water into the wash tub;

determining a fill time at which the fluid level sensor senses a predetermined fill level while the controller controls the water inlet to dispense water into the wash tub;

after the predetermined fill level is sensed, controlling the water inlet to stop dispensing water into the wash tub;

determining a peak time at which the fluid level sensor senses a stabilization of fluid level after the controller controls the water inlet to stop dispensing water into the wash tub;

determining a polyester sense criterion, a cotton sense criterion, a towels sense criterion, a polyester fill criterion, and a cotton peak criterion using the determined dry weight;

selecting the polyester load type if the sense time meets the polyester sense criterion or if the fill time meets the polyester fill criterion;

selecting the towels load type if the sense time meets the towels sense criterion;

selecting the cotton load type if the sense time meets the cotton sense criterion without meeting the towels sense criterion or if the peak time meets the cotton peak criterion; and otherwise selecting the mixed load type.

2. A laundry washing machine, comprising:

a wash tub disposed within a housing;

a water inlet configured to dispense water into the wash tub;

a fluid level sensor configured to sense a fluid level in the wash tub; and a controller coupled to the water inlet and the fluid level sensor, the controller configured to initiate an initial fill phase of a wash cycle by controlling the water inlet to dispense water into the wash tub and to dynamically select a load type for a load disposed in the wash tub from among a plurality of load types based at least in part on a first time at which the fluid level sensor senses a predetermined fluid level while the controller controls the water inlet to dispense water into the wash tub and a peak time that is calculated based at least in part on a time elapsed between the controller controlling the water inlet to stop dispensing water into the wash tub and the fluid level sensor sensing a stabilization of fluid level.

3. The laundry washing machine of claim 2, wherein the predetermined fluid level is a first predetermined fluid level, and wherein the controller is further configured to dynamically select the load type based at least in part on a fill time at which the fluid level sensor senses a second predetermined fluid level while the controller controls the water inlet to dispense water into the wash tub.

4. The laundry washing machine of claim 3, wherein the first time is a sense time, the first predetermined fluid level is a first detected change in fluid level sensed by the fluid level sensor and the second predetermined fluid level is a minimum fill fluid level sensed by the fluid level sensor.

5. The laundry washing machine of claim 2, wherein the predetermined fluid level is a first detected change in fluid level sensed by the fluid level sensor.

6. The laundry washing machine of claim 2, wherein the predetermined fluid level is a minimum fill fluid level sensed by the fluid level sensor.

7. The laundry washing machine of claim 2, wherein the controller is configured to determine the stabilization of fluid level being sensed by the fluid level sensor in part by determining a substantially constant fluid level for a predetermined stabilization duration.

8. The laundry washing machine of claim 2, wherein the controller is further configured to dynamically select the load type prior to sensing the peak time in response to determining that the first time meets a predetermined criterion.

9. The laundry washing machine of claim 2, wherein the controller is configured to dynamically select the load type further by comparing the first time and the peak time against a plurality of load type criteria respectively associated with different load types among the plurality of load types.

10. The laundry washing machine of claim 9, further comprising a weight sensor, wherein the controller is configured to determine a weight of the load using the weight sensor and to determine the plurality of load type criteria using the determined weight.

11. The laundry washing machine of claim 10, wherein at least a subset of the plurality of load type criteria are determined from linear equations that are functions of load weight.

12. The laundry washing machine of claim 10, further comprising a door providing access to the wash tub and a rotatable basket disposed in the wash tub and configured to support the load, wherein the weight sensor includes a load cell disposed proximate a corner of the housing, wherein the fluid level sensor comprises a pressure sensor in fluid communication with the wash tub, and wherein the controller is configured to determine the weight of the load by:

determining a tare weight of the wash tub using the weight sensor in response to opening of the door;

rotating the rotatable basket and determining a loaded weight of the wash tub using the weight sensor during rotation of the rotatable basket; and determining the weight of the load from a difference between the loaded weight and the tare weight of the wash tub.

13. The laundry washing machine of claim 9, wherein the predetermined fluid level is a first detected change in fluid level sensed by the fluid level sensor, wherein the plurality of load type criteria includes a polyester sense criterion and a towels sense criterion, and wherein the controller is configured to dynamically select the load type by selecting a polyester load type in response to the first time meeting the polyester sense criterion and selecting a towels load type in response to the first time meeting the towels sense criterion.

14. The laundry washing machine of claim 13, wherein the plurality of load type criteria includes a cotton sense criterion, and wherein the controller is further configured to dynamically select the load type by selecting a cotton load type in response to the first time meeting the cotton sense criterion without meeting the towels sense criterion.

15. The laundry washing machine of claim 14, wherein the plurality of load type criteria includes a cotton peak criterion and wherein the controller is further configured to dynamically select the load type by selecting the cotton load type in response to the peak time meeting the cotton peak criterion.

16. The laundry washing machine of claim 13, wherein the predetermined fluid level is a first predetermined fluid level, wherein the controller is further configured to dynamically select the load type based at least in part on a fill time at which the fluid level sensor senses a second predetermined fluid level while the controller controls the water inlet to dispense water into the wash tub, wherein the plurality of load type criteria includes a polyester fill criterion and wherein the controller is further configured to dynamically select the load type by selecting the polyester load type in response to the fill time meeting the polyester fill criterion.

17. The laundry washing machine of claim 13, wherein the controller is further configured to dynamically select the load type by selecting a mixed load type in response to a failure to meet any of the plurality of load type criteria.

18. The laundry washing machine of claim 2, wherein the controller is further configured to control a wash or rinse temperature, a wash or rinse water amount, an agitation duration, an agitation stroke, a soak duration, a spin speed, a spin duration, a cycle time, or a number of phase repeats in response to the selected load type.

19. A laundry washing machine, comprising:

a wash tub disposed within a housing;

a water inlet configured to dispense water into the wash tub;

a fluid level sensor configured to sense a fluid level in the wash tub; and a controller coupled to the water inlet and the fluid level sensor, the controller configured to initiate an initial fill phase of a wash cycle by controlling the water inlet to dispense water into the wash tub and to dynamically select a load type for a load disposed in the wash tub from among a plurality of load types based at least in part on a first time at which the fluid level sensor senses a predetermined fluid level while the controller controls the water inlet to dispense water into the wash tub and a peak time at which the fluid level sensor senses a stabilization of fluid level after the controller controls the water inlet to stop dispensing water into the wash tub;

wherein the predetermined fluid level is a first predetermined fluid level, and wherein the controller is further configured to dynamically select the load type based at least in part on a fill time at which the fluid level sensor senses a second predetermined fluid level while the controller controls the water inlet to dispense water into the wash tub; and wherein the controller is configured to dynamically select the load type further by:

selecting a first load type in response to the first time meeting a first load type criterion;

selecting the first load type in response to the peak time meeting a second load type criterion even if the first time does not meet the first load type criterion;

selecting a second load type in response to the first time meeting a third load type criterion;

selecting the second load type in response to the fill time meeting a fourth load type criterion even if the first time does not meet the third load type criterion; and selecting a mixed load type in response to none of the first, second, third and fourth load type criteria being met.

20. A laundry washing machine, comprising:

a wash tub disposed within a housing;

a water inlet configured to dispense water into the wash tub;

a fluid level sensor configured to sense a fluid level in the wash tub; and a controller coupled to the water inlet and the fluid level sensor, the controller configured to initiate an initial fill phase of a first wash cycle by controlling the water inlet to dispense water into the wash tub, to dynamically select a first load type for a first load disposed in the wash tub from among a plurality of load types based at least in part on a plurality of times determined based upon fluid levels sensed by the fluid level sensor during the first wash cycle, and, for a second wash cycle performed for a second load disposed in the wash tub after completion of the first wash cycle, to dynamically select a second load type for the second load from among the plurality of load types after sensing only a subset of the plurality of times and prior to sensing at least one of the plurality of times in response to determining that an earlier reached time in the subset of the plurality of times meets a predetermined criterion.

* * * * *